US008511284B2

(12) United States Patent
Matsuki et al.

(10) Patent No.: US 8,511,284 B2
(45) Date of Patent: Aug. 20, 2013

(54) FUEL SUPPLY APPARATUS OF INTERNAL COMBUSTION ENGINE AND CONTROL DEVICE OF FUEL SUPPLY APPARATUS

(75) Inventors: Hiroshi Matsuki, Saitama (JP); Hirotaka Kaneko, Saitama (JP); Muneyuki Yoshida, Saitama (JP)

(73) Assignee: Bosch Corporation, Tokyo (JP)

( * ) Notice: Subject to any disclaimer, the term of this patent is extended or adjusted under 35 U.S.C. 154(b) by 627 days.

(21) Appl. No.: 12/811,027

(22) PCT Filed: Aug. 1, 2008

(86) PCT No.: PCT/JP2008/063883
§ 371 (c)(1),
(2), (4) Date: Jun. 28, 2010

(87) PCT Pub. No.: WO2009/084263
PCT Pub. Date: Jul. 9, 2009

(65) Prior Publication Data

US 2010/0307460 A1 Dec. 9, 2010

(30) Foreign Application Priority Data

Dec. 28, 2007 (JP) ..... 2007-339055

(51) Int. Cl.
*F02M 37/20* (2006.01)

(52) U.S. Cl.
USPC ..... 123/516; 123/458; 123/467; 123/511; 123/514

(58) Field of Classification Search
USPC ..... 123/456, 458, 467, 511, 514, 516
See application file for complete search history.

(56) References Cited

U.S. PATENT DOCUMENTS

| | | | | |
|---|---|---|---|---|
| 6,058,912 | A * | 5/2000 | Rembold et al. | 123/516 |
| 6,772,738 | B2 * | 8/2004 | Rembold et al. | 123/514 |
| 6,959,697 | B2 * | 11/2005 | Kojima | 123/516 |
| 8,196,567 | B2 * | 6/2012 | Pursifull et al. | 123/495 |
| 2003/0041838 | A1 * | 3/2003 | Tsuchiya | 123/299 |
| 2006/0231080 | A1 * | 10/2006 | Tomatsuri et al. | 123/516 |

FOREIGN PATENT DOCUMENTS

| | | | |
|---|---|---|---|
| EP | 1712777 | A1 | 10/2006 |
| JP | 8121281 | A | 5/1996 |
| JP | 2003148271 | A | 5/2003 |
| JP | 2003184696 | A | 7/2003 |
| JP | 2003239823 | A | 8/2003 |

* cited by examiner

*Primary Examiner* — Erick Solis
(74) *Attorney, Agent, or Firm* — Michael Best & Friedrich LLP

(57) ABSTRACT

A fuel supply apparatus of an internal combustion engine is provided which can discharge air bubbles or air from within fuel supply paths while increasing pressure within a common rail up to a predetermined pressure level before a start of the internal combustion engine, can reduce a period of time of cranking from when an ignition switch is switched on and which can reduce noise that occurs when the air bubbles or air are being discharged.

The fuel supply apparatus is provided with a flow rate control valve that adjusts a flow rate of fuel supplied to the common rail and a pressure control valve that reduces the pressure within the common rail. The fuel supply apparatus is further provided with: a pre-start drive control portion that performs a pre-start drive of an electromagnetic low pressure pump before the start of the internal combustion engine; a flow rate control valve control portion that maintains the flow rate control valve in an open state while the pre-start drive is being performed; and a pressure control valve control portion that maintains the pressure control valve in a closed state and performs a control that opens the pressure control valve at least once for a short time period while the pre-start drive is being performed.

9 Claims, 13 Drawing Sheets

Prior Art

Prior Art

FUEL SUPPLY APPARATUS OF INTERNAL COMBUSTION ENGINE AND CONTROL DEVICE OF FUEL SUPPLY APPARATUS

TECHNICAL FIELD

The present invention relates to a fuel supply apparatus of an internal combustion engine and a control device of the fuel supply apparatus. Particularly, it relates to a fuel supply apparatus of an internal combustion engine and a control device of the fuel supply apparatus in which a low pressure pump is driven before the internal combustion engine starts.

BACKGROUND ART

In known art, as an apparatus that supplies fuel to an internal combustion engine such as a diesel engine, an accumulator fuel supply apparatus (common rail apparatus) has been used, which enables precise fuel injection through energization control of fuel injection valves by constantly supplying high pressure fuel to each fuel injection valve, the accumulator fuel supply apparatus being provided with a common rail to which a plurality of fuel injection valves are connected and in which high pressure fuel is accumulated.

This accumulator fuel supply apparatus is provided with a fuel tank, a low-pressure pump, a high pressure pump, the common rail, and the fuel injection valves. Note that, fuel inside the fuel tank is pumped up by the low-pressure pump, and the fuel is fed to the high pressure pump. The high pressure pump highly pressurizes the fuel and pressure feeds the fuel to the common rail. Consequently, the energization control of the fuel injection valves is performed and the fuel injection to the internal combustion engine is controlled in a state where high pressure fuel is supplied to each fuel injection valve.

Further, with this accumulator fuel supply apparatus, a flow rate of fuel fed to the common rail can be changed in accordance with a required rail pressure and injection quantity. The flow rate of fuel is adjusted by a flow rate control valve that is provided in a fuel passage that connects the low pressure pump and a pressurizing chamber of the high pressure pump. Furthermore, an overflow valve is provided in the fuel passage that leads to the flow rate control valve such that the flow rate of fuel is accurately adjusted by the flow rate control valve. Then, if the pressure of the low pressure fuel that is supplied to the flow rate control valve exceeds a predetermined value, some of the low pressure fuel is returned to the fuel tank through the overflow valve, and the pressure of the low pressure fuel that is fed to the flow rate control valve is maintained such that it does not exceed the predetermined value.

With regard to this type of accumulator fuel supply apparatus, various apparatus that adopt an electromagnetic low pressure pump as the low pressure pump have been proposed to improve startability of the internal combustion engine.

For example, as a fuel injection apparatus that starts fuel injection to the internal combustion engine promptly when the internal combustion engine starts, a fuel injection apparatus as shown in FIG. 12 has been disclosed (refer to Patent Document 1). This fuel injection apparatus is provided with fuel injection valves 302 that are installed in an internal combustion engine 301, injection control electromagnetic valves 303, a common rail 304, a high pressure pump 307, a fuel tank 308, a low pressure pump 309, and an ECU 311. After the ECU 311 determines that the internal combustion engine is to be stopped, if $Pc \leqq P1$, where Pc is a fuel pressure within the common rail 304 and P1 is a predetermined pressure, when an ignition switch is turned on, the ECU 311 determines that a driver has an intention to restart the internal combustion engine, and the ECU 311 pressure feeds pressurized fuel to the common rail 304 by operating the low pressure pump 309 until a starter switch is turned on.

Further, an accumulator fuel injection apparatus has been proposed, which can reduce an air quantity supplied into a fuel sump of the fuel injection valve from a pressurizing chamber of a supply pump via the common rail when the internal combustion engine is started, such that injection quantity metering is stabilized when the internal combustion engine is started. More specifically, a fuel injection apparatus has been disclosed (refer to Patent Document 2) as shown in FIG. 13, in which, when the internal combustion engine is started, as a target common rail pressure is low, even if a necessary pumping quantity of a supply pump 353 is lowered, there is no problem in terms of injection quantity metering accuracy. Therefore, a pressure control valve 356 is driven (opened) for a predetermined period of time when the internal combustion engine is started, such that fuel within a common rail 351 is discharged from the pressure control valve 356 into a fuel tank 355 via fuel return flow paths 363, 364 and 365, and air entered into the supply pump 353 is discharged from a high pressure fuel path when a vehicle is left standing for a long period of time after stopping the internal combustion engine.

Patent document 1: Japanese Patent Application Publication No. JP-A-8-121281 (all text and all figures)

Patent document 2: Japanese Patent Application Publication No. JP-A-2003-239823 (all text and all figures)

DISCLOSURE OF THE INVENTION

Problems that the Invention is to Solve

Then, when the low pressure pump can be controlled to operate in advance until the common rail pressure rises up to a predetermined pressure level before the internal combustion engine is started, as described in Patent Document 1, the control that is described in Patent Document 2, in which the pressure control valve is opened for the predetermined period of time when the internal combustion engine is started and the air intruded into the supply pump is discharged from inside the high pressure fuel path, can be performed before the internal combustion engine is started. In other words, even though Patent Document 2 discloses that as the target common rail pressure is low when the internal combustion engine is started, even when the necessary pumping quantity of the supply pump is lowered, there is no problem in terms of injection quantity metering accuracy, but before the internal combustion engine is started, since injection control itself is not performed, control can be performed to discharge air bubbles or air without taking into account the injection quantity accuracy.

However, the flow rate of fuel that is pressure fed by the low pressure pump is set at, for example, approximately 200 L/h, and when driving of the low pressure pump is started while opening the pressure control valve before the internal combustion engine is started and the fuel is supplied into the common rail system, a relatively large quantity of fuel is circulated within the common rail system and the fuel tank, and the fuel passes through each portion that exists within the system. Consequently, there is a risk that a vibration of a valve, a pipe etc. may arise, or a noise may arise that is thought to be caused by the relationship between an effective flow path area and an internal pressure of a flow path through which the fuel passes. There is also a possibility that the driver etc. will hear an irritating noise since the internal combustion engine has not yet been started.

To address this, the inventors of the present invention have made earnest efforts and completed the present invention after finding that this kind of problem can be solved by starting to drive the low pressure pump before the internal combustion engine is started, while closing one of either the flow rate control valve and the pressure control valve, and performing control to open one of the closed flow rate control valve and the closed pressure control valve at least once for a short period of time. Namely, an object of the present invention is to provide a fuel supply apparatus of an internal combustion engine in which air bubbles or air can be discharged from inside a fuel supply path while raising the pressure within a common rail up to a predetermined pressure level before starting an internal combustion engine, a cranking time after turning on an ignition switch can be shortened, and noise that is made when the air bubbles or air is discharged can be reduced.

Means for Solving the Problems

According to the present invention, the above-mentioned problems can be solved by providing a fuel supply apparatus of an internal combustion engine that supplies fuel inside a fuel tank to a high pressure pump by a low pressure pump, highly pressurizes the fuel by the high pressure pump, pressure feeds the fuel to a common rail that is connected to a fuel injection portion of the internal combustion engine, and supplies the fuel from the fuel injection portion to the internal combustion engine. The fuel supply apparatus includes a flow rate control valve that adjusts a flow rate of the fuel supplied to the common rail, and a pressure control valve that reduces pressure within the common rail. The fuel supply apparatus is characterized by comprising: a pre-start drive control portion that performs a pre-start drive of the low pressure pump before a start of the internal combustion engine; a flow rate control valve control portion that, while the pre-start drive is being performed, maintains the flow rate control valve in an open state; and a pressure control valve control portion that, while the pre-start drive is being performed, maintains the pressure control valve in a closed state and performs a control that opens the pressure control valve at least once for a short time period.

Further, it is preferable that the fuel supply apparatus of the internal combustion engine according to the present invention is structured such that a total time of the pressure control valve opening time during the period when the pre-start drive is being performed is set in accordance with an air quantity that enters into the fuel supply apparatus.

Further, it is preferable that the fuel supply apparatus of the internal combustion engine according to the present invention is structured such that the control that opens the pressure control valve is performed at least once for the short time period when restarting the internal combustion engine after the fuel of the internal combustion engine runs out.

Further, it is preferable that the fuel supply apparatus of the internal combustion engine according to the present invention is structured such that the fuel supply apparatus of the internal combustion engine is provided with pressure detecting means for detecting pressure of the fuel inside a fuel supply path between the low pressure pump and the flow rate control valve, and the pressure control valve control portion opens the pressure control valve at least once for the short time period in a state in which the pressure detected by the pressure detecting means exceeds a predetermined value.

Further, another form of the present invention is a fuel supply apparatus of an internal combustion engine that supplies fuel inside a fuel tank to a high pressure pump by a low pressure pump, highly pressurizes the fuel by the high pressure pump, pressure feeds the fuel to a common rail that is connected to a fuel injection portion of the internal combustion engine, and supplies the fuel from the fuel injection portion to the internal combustion engine. The fuel supply apparatus includes: a flow rate control valve that adjusts a flow rate of the fuel supplied to the common rail, and a pressure control valve that reduces pressure within the common rail. The fuel supply apparatus is characterized by comprising: a pre-start drive control portion that performs a pre-start drive of the low pressure pump before a start of the internal combustion engine; a pressure control valve control portion that, while the pre-start drive is being performed, maintains the pressure control valve in an open state; and a flow rate control valve control portion that, while the pre-start drive is being performed, maintains the flow rate control valve in a closed state and performs a control that opens the flow rate control valve at least once for a short time period.

Further, yet another form of the present invention is a control device of a fuel supply apparatus that performs pre-start control of an internal combustion engine in the fuel supply apparatus that supplies fuel inside a fuel tank to a high pressure pump by a low pressure pump, highly pressurizes the fuel by the high pressure pump, pressure feeds the fuel to a common rail that is connected to a fuel injection portion of the internal combustion engine, and supplies the fuel from the fuel injection portion to the internal combustion engine. The fuel supply apparatus is characterized by comprising: a pre-start drive control portion that performs a pre-start drive of the low pressure pump before a start of the internal combustion engine; a flow rate control valve control portion that, while the pre-start drive is being performed, maintains the flow rate control valve that adjusts a flow rate of the fuel supplied to the common rail in an open state; and a pressure control valve control portion that, while the pre-start drive is being performed, maintains the pressure control valve that reduces pressure within the common rail in a closed state and performs a control that opens the pressure control valve at least once for a short time period.

Further, yet another form of the present invention is a control device of a fuel supply apparatus that performs pre-start control of an internal combustion engine in the fuel supply apparatus that supplies fuel inside a fuel tank to a high pressure pump by a low pressure pump, highly pressurizes the fuel by the high pressure pump, pressure feeds the fuel to a common rail that is connected to a fuel injection portion of the internal combustion engine, and supplies the fuel from the fuel injection portion to the internal combustion engine. The fuel supply apparatus is characterized by comprising: a pre-start drive control portion that performs a pre-start drive of the low pressure pump before a start of the internal combustion engine; a pressure control valve control portion that, while the pre-start drive is being performed, maintains the pressure control valve that reduces pressure within the common rail in an open state; and a flow rate control valve control portion that, while the pre-start drive is being performed, maintains the flow rate control valve that adjusts a flow rate of the fuel supplied to the common rail in a closed state and performs a control that opens the flow rate control valve at least once for a short time period.

Advantage of the Invention

According to the fuel supply apparatus of the internal combustion engine and the control device of the fuel supply apparatus of the present invention, before the start of the internal combustion engine, by performing control that opens the pressure control valve at least once for a short period of time while starting drive of the low pressure pump while opening the flow rate control valve and maintaining the pressure control valve, which is connected to the common rail, in a closed state, pressure within the common rail can be increased up to a predetermined pressure level before the start of the internal combustion engine, and also, air bubbles or air within the fuel supply paths can be discharged while suppressing the occurrence of noise. Therefore, the period of time from the start of cranking to the start of the internal combustion engine can be shortened, and also a load on a battery can be reduced.

Further, the fuel supply apparatus of the internal combustion engine of the present invention is structured such that, by setting the total time of the pressure control valve opening time in accordance with an air quantity existing within the fuel supply paths, the air bubbles or air within the fuel supply paths are reliably discharged, and the occurrence of noise can be effectively suppressed.

Further, the fuel supply apparatus of the internal combustion engine of the present invention is structured such that, by performing the above-described control that opens the pressure control valve at the time of restarting the engine after the fuel runs out, before the start of the internal combustion engine, the air bubbles or air that are held within the fuel supply paths can be discharged while suppressing the occurrence of noise that is irritating to the ear, and the fuel supply paths can be quickly filled with fuel at a predetermined pressure level. As a result, when restarting a vehicle that has run out of fuel, the cranking time of the internal combustion engine is shortened, and the startability of the internal combustion engine is improved.

Further, the fuel supply apparatus of the internal combustion engine of the present invention is structured such that, by opening the pressure control valve for a short period of time in a state in which a pressure value at a predetermined location in the fuel supply paths exceeds a predetermined value, the air bubbles and air are effectively discharged, and the occurrence of noise is effectively suppressed as the period of time required for discharging the air bubbles etc. is shortened to a minimum.

Further, the fuel supply apparatus of the internal combustion engine and the control device of the fuel supply apparatus of the present invention is structured such that, before the start of the internal combustion engine, control can also be performed that opens the flow rate valve once for a short period of time while starting driving of the low pressure pump while closing the flow rate valve and maintaining the pressure control valve, which is connected to the common rail, in an open state. Even in a case in which this kind of control is performed, the pressure within the common rail can be increased up to the predetermined pressure level before the start of the internal combustion engine, and also, the air bubbles or air within the fuel supply paths can be discharged while suppressing the occurrence of noise.

BEST MODE FOR CARRYING OUT THE INVENTION

Figure 1:
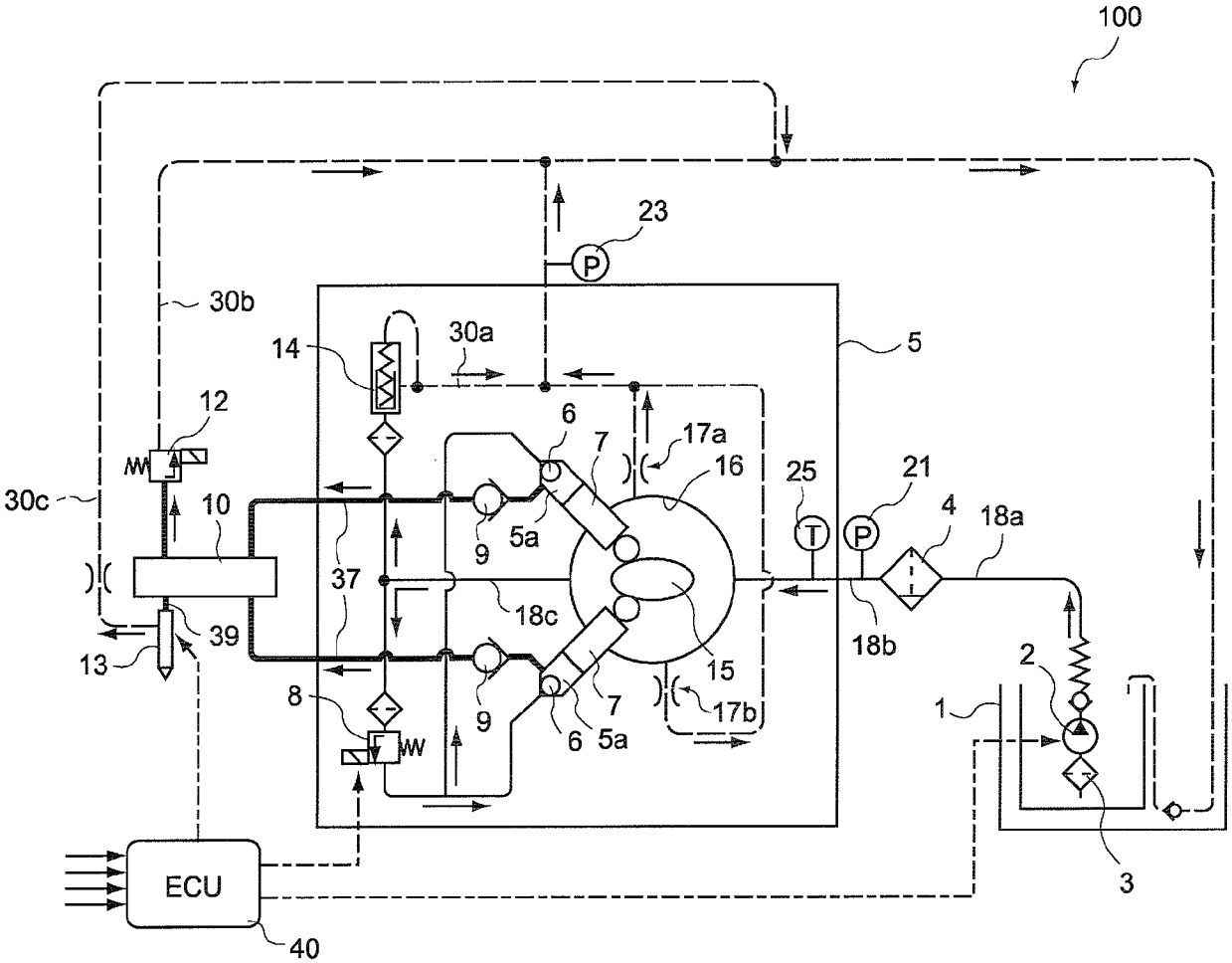
FIG. 1 is a diagram showing an example of a structure of a fuel supply apparatus of an internal combustion engine according to a first embodiment of the present invention.

With reference to the appended figures, embodiments of the present invention relating to a fuel supply apparatus of an internal combustion engine and a control device of the fuel supply apparatus will be explained in concrete terms below. Note that, the following embodiments illustrate one form of the present invention, and do not limit the present invention and can be modified as chosen within the scope of the present invention.

Note that structural members with the same reference numeral in each figure indicate the same members, and explanations thereof are omitted as appropriate.

First Embodiment

1. Overall Structure of Fuel Supply Apparatus of Internal Combustion Engine FIG. 1 shows a schematic structure of a fuel supply apparatus 100 of an internal combustion engine according to a first embodiment of the present invention. The fuel supply apparatus 100 includes a fuel supply apparatus control device (hereinafter referred to as an Electronic Control Unit (ECU)) 40 according to the first embodiment.

The fuel supply apparatus 100 shown in FIG. 1 is the fuel supply apparatus 100 of a diesel engine, and the main structural elements of the fuel supply apparatus 100 are a fuel tank 1, an electromagnetic low pressure pump 2, a high pressure pump 5, a common rail 10 and a fuel injection valve 13 etc. Each structural element is connected by a fuel passage, and in FIG. 1, a high pressure fuel passage 37 is shown by a bold line, low pressure fuel passages 18*a* to 18*c* are shown by thin lines, and fuel return flow paths 30*a* to 30*c* are shown by dotted lines.

The electromagnetic low pressure pump 2, which is provided in the fuel tank 1 in which fuel is stored, supplies low pressure fuel to a pressurizing chamber 5*a* of the high pressure pump 5 via the low pressure fuel passages 18*a* to 18*c*. The electromagnetic low pressure pump 2 is driven by an electric current that is supplied from a battery and is structured such that it pressure feeds the low pressure fuel at a predetermined flow rate. Therefore, even when the internal combustion engine is stopped, it is possible to drive the electromagnetic low pressure pump 2.

Further, a pre-filter 3 is disposed at a fuel suction opening of the electromagnetic low pressure pump 2 such that when contaminants are mixed within the fuel tank 1, those contaminants are captured and collected to prevent them from being suctioned. Furthermore, a main filter 4 is provided between the low pressure fuel passages 18*a* and 18*b* that connect the fuel tank 1 and the high pressure pump 5 and the contaminants in the fuel are also captured and collected by this main filter 4 to prevent the contaminants from flowing into the high pressure pump 5.

The high pressure pump 5 uses a plunger 7 to pressurize the low pressure fuel that is pressure fed by the electromagnetic low pressure pump 2 and introduced into the pressurizing chamber 5*a* via a fuel inlet valve 6, and then pressure feeds the fuel to the common rail 10 via a fuel outlet valve 9 and the high pressure fuel passage 37. According to the example of the fuel supply apparatus 100 of the present embodiment, the low pressure fuel, which is fed into the high pressure pump 5 via the low pressure fuel passages 18*a* and 18*b*, once flows into a cam chamber 16, and is then further fed to the pressurizing chamber 5*a* via the low pressure fuel passage 18*c*.

Further, a flow rate control valve 8 is provided along the low pressure fuel passage 18*c* that connects the cam chamber 16 and the pressurizing chamber 5*a*, and the flow rate control valve 8 feeds the low pressure fuel to the pressurizing chamber 5*a*, while adjusting a flow rate in accordance with a required common rail pressure and fuel injection quantity. As a result, a pumping quantity of the high pressure fuel that is fed from the high pressure pump 5 to the common rail 10 is adjusted. This flow rate control valve 8 can be, for example, an electromagnetic proportional type flow rate control valve.

Further, an overflow valve 14 is provided on a side further upstream from the flow rate control valve 8, the overflow valve 14 branching from and being connected to the low pressure fuel passage 18*c* and being arranged in a parallel manner with the flow rate control valve 8. The overflow valve 14 is further connected to the fuel return flow path 30*a* that leads to the fuel tank 1. For this overflow valve 14, an overflow valve is used that is opened when a front and rear pressure difference of the overflow valve 14, namely a difference between pressure within the low pressure fuel passages 18*a* to 18*c* and the cam chamber 16 etc. and pressure within the fuel return flow path 30*a* that runs between the overflow valve 14 and the fuel tank 1, exceeds a predetermined value. Therefore, in a state where the low pressure fuel is pressure fed by the electromagnetic low pressure pump 2, the pressure within the low pressure fuel passage 18*a* to 18*c* and the cam chamber 16 is maintained to be greater than the pressure within the fuel return flow path 30*a* by the predetermined pressure difference.

Here, with the example of the fuel supply apparatus 100 according to the present embodiment, some of the low pressure fuel that flows into the cam chamber 16 permeates into each portion of the high pressure pump 5 where it is also used as a lubricating oil. In particular, a cam shaft (not shown in the figures) to which a cam 15 that drives the high pressure pump 5 is fixed is supported by a bearing (not shown in the figures) that is provided within a pump housing, and some of the low pressure fuel within the cam chamber 16 permeates into clearances 17*a* and 17*b* that are formed between the cam shaft and the bearing such that the lubrication is ensured. These clearances 17*a* and 17*b* are also connected to the fuel return flow path 30*a*, and by maintaining the difference between the pressure within the cam chamber 16 and the pressure within the fuel return flow path 30*a* at the predetermined level, some of the low pressure fuel is returned to the fuel return flow path 30*a* through the clearances 17*a* and 17*b* such that the fuel functions as the lubricating oil.

Figure 2:
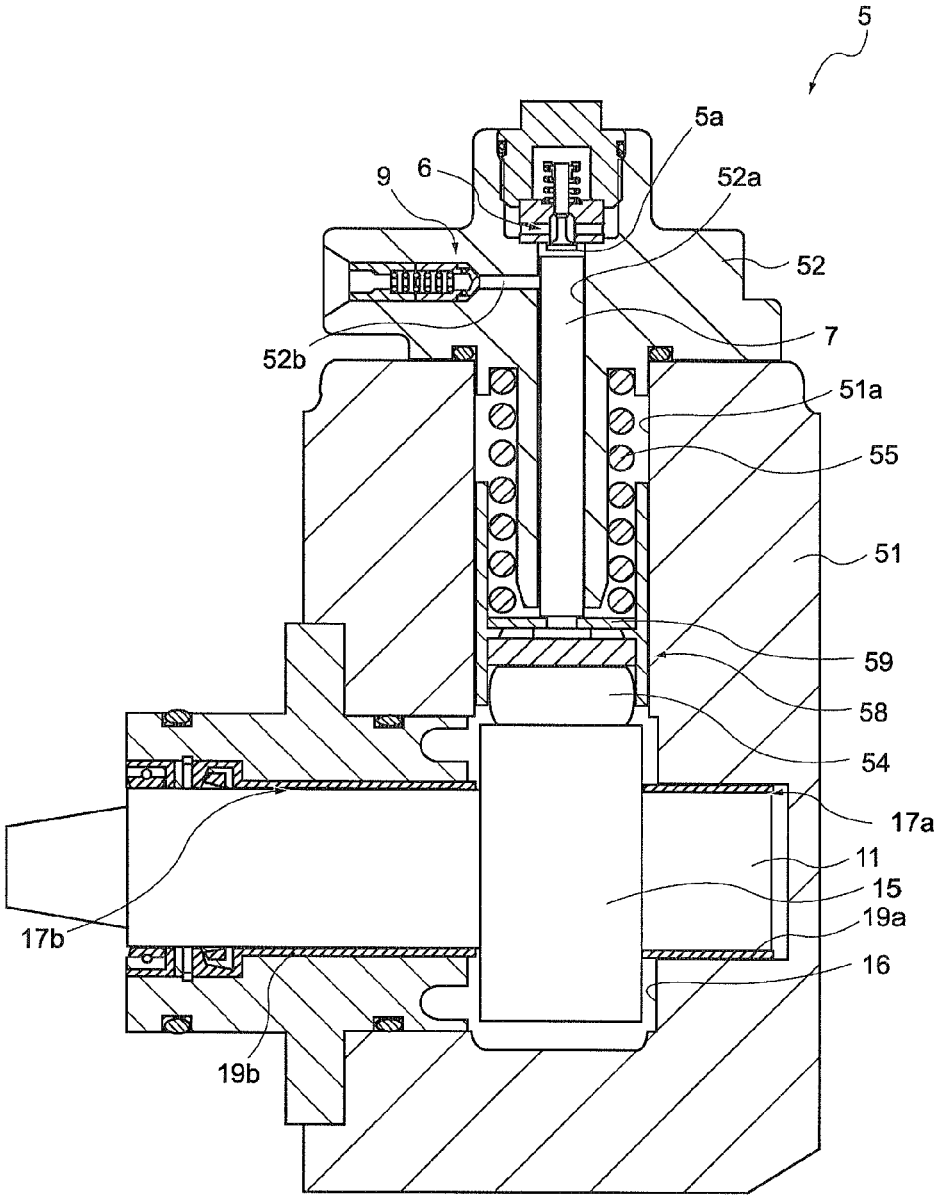
FIG. 2 is a diagram illustrating an example of a structure of a high pressure pump.

FIG. 2 shows a concrete example of the structure of the high pressure pump 5. This high pressure pump 5 is provided with a pump housing 51, a cylinder head 52 that is fitted inside a cylindrical space 51*a* of the pump housing 51, the plunger 7 that is slidably retained by a cylinder 52*a* of the cylinder head 52, a spring 55 whose ends are fixed to the cylinder head 52 and a spring seat 59 such that the spring 55 urges the plunger 7 in a downward direction, and a tappet structure body 58 that is disposed between the plunger 7 and the cam 15 such that the tappet structure body 58 pushes up the plunger 7 while centering the plunger 7 as the cam 15 rotates. Further, the fuel inlet valve 6 is arranged at an upper opening of the cylinder 52*a* of the cylinder head 52, and the fuel outlet valve 9 is arranged horizontally in relation to an axial direction of the cylinder 52*a* via a fuel outlet path 52*b*.

Note that in FIG. 2, the flow rate control valve 8 and the overflow valve 14 that are provided in the high pressure pump 5 are not shown in the figure.

In the high pressure pump 5, a part of the cylinder 52*a* of the cylinder head 52 is blocked by an inner peripheral surface of the cylinder head 52, the plunger 7, the fuel inlet valve 6, and the fuel outlet valve 9, forming the pressurizing chamber 5*a*. Then, fuel that flows into the pressurizing chamber 5*a* via the fuel inlet valve 6 is pressurized inside the pressurizing chamber 5*a* by the plunger 7 that is pushed up in accordance with a rotational movement of the cam 15, and, by pushing open the fuel outlet valve 9, the highly pressurized fuel is pressure fed to a common rail (not shown in the figures) provided on a downstream side.

As described above, with this high pressure pump 5, after some of the low pressure fuel that is pressure fed by the electromagnetic low pressure pump (refer to FIG. 1) flows into the cam chamber 16, some of the low pressure fuel permeates into the clearances 17*a* and 17*b* that are formed between a cam shaft 11 and bearings 19*a* and 19*b* that support the cam shaft 11, and functions as the lubricating oil. Further, some of the low pressure fuel within the cam chamber 16 comes and goes between the cam chamber 16 and the cylindrical space 51*a*, and functions as the lubricating oil while circulating around an abutting portion between a roller 54 of the tappet structure body 58 and the cam 15, a sliding portion between an inner peripheral surface of the cylindrical space 51*a* and an outer peripheral surface of the tappet structure body 58, and the above-described sliding portion of the plunger 7. With this fuel lubrication using the low pressure fuel, as long as a flow rate of the low pressure fuel fed by the high pressure pump 5 is ensured, a fuel pressure within the cam chamber 16 is maintained equal to or greater than a predetermined pressure by the overflow valve. As a result, the fuel circulates around each sliding portion etc., and the fuel lubrication functions normally.

Further, with this high pressure pump 5, to inhibit seizure caused by reciprocation of the plunger 7, some of the fuel inside the pressurizing chamber 5*a* is allowed to leak to a sliding portion between the inner peripheral surface of the cylinder 52*a* of the cylinder head 52 and an outer peripheral surface of the plunger 7 such that the fuel functions as the lubricating oil.

Further, the common rail 10 shown in FIG. 1 stores the high pressure fuel pressure fed from the high pressure pump 5, and the high pressure fuel is supplied to a plurality of fuel injection valves 13 that are connected via a high pressure fuel passage 39. This common rail 10 is provided with a rail pressure sensor (not shown in the figures) and a pressure control valve 12. The pressure control valve 12 can be, for example, an electromagnetic proportional control valve. A value detected by the rail pressure sensor is transmitted to the ECU, and based on the value, not only the pressure control valve 12 provided in the common rail 10, but also the flow rate control valve 8 provided in the high pressure pump 5 are controlled. Then, some of the fuel pressure fed from the high pressure pump 5 is discharged into the fuel return flow path 30*b* by the pressure control valve 12 such that pressure within the common rail 10 is adjusted to a preferred value.

Further, the fuel injection valve 13, which is a fuel injection portion connected to the common rail 10, controls the injection of the high pressure fuel supplied from the common rail 10 such that the fuel is supplied into a cylinder of the internal combustion engine. There is no particular limitation to the type of the fuel injection valve 13, and, for example, a known electromagnetic control type fuel injection valve or piezo type fuel injection valve can be used. In this example shown in FIG. 1, an electromagnetic control type fuel injection valve is used as the fuel injection valve 13, and is used to control back pressure of the fuel injection valve 13, such that discharged fuel is returned to the fuel tank 1 via the fuel return flow path 30*c*.

Further, in the fuel supply apparatus 100 according to the present embodiment, an entrance side pressure sensor 21 is provided in the low pressure fuel passage 18*b* that connects the electromagnetic low pressure pump 2 and the high pressure pump 5. This entrance side pressure sensor 21 detects pressure within the low pressure fuel passages 18*a* to 18*c* and the cam chamber 16 (hereinafter referred to as "entrance pressure"), and a signal that indicates a detected pressure value is transmitted to the ECU, the signal being used for control before the start of the fuel supply apparatus 100. Further, an exit side pressure sensor 23 is provided in the fuel return flow path 30*a* that connects the overflow valve 14, which is provided in the high pressure pump 5, and the fuel tank 1. This exit side pressure sensor 23 detects pressure within the fuel return flow path 30*a* (hereinafter referred to as "exit pressure"), and, in the same manner as the entrance side pressure sensor 21, it transmits a signal that indicates a detected pressure value to the ECU.

The entrance side pressure sensor 21 and exit side pressure sensor 23 may be installed on a housing of the high pressure pump 5 etc. to detect a pressure value within a fuel passage that is formed by the housing etc., or they may be installed in a fuel pipe that is connected to the high pressure pump 5 to detect a pressure value within the fuel pipe.

2. Control Device (ECU) of Fuel Supply Apparatus

Figure 3:
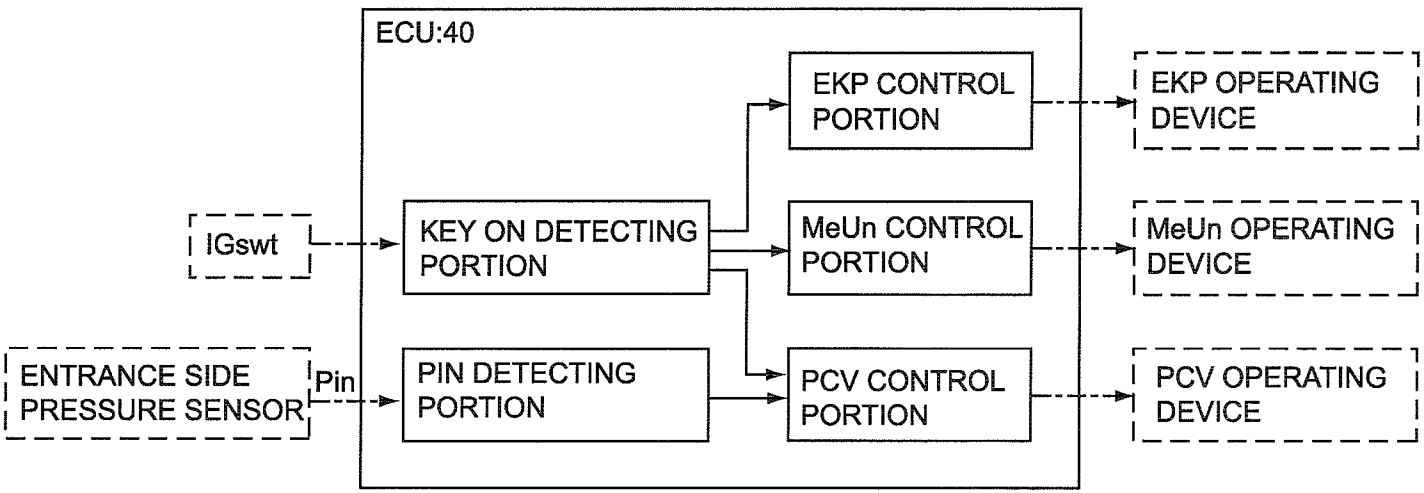
FIG. 3 is a diagram showing an example of a structure of a control device of the fuel supply apparatus according to the first embodiment.

FIG. 3 shows a structural example of the ECU 40 that controls the above-described fuel supply apparatus 100 according to the above-described present embodiment, in which parts of the ECU 40 that relate to pre-start control performed before the start of the internal combustion engine are displayed as functional blocks.

The main elements that form the ECU 40 of the present embodiment are: a key ON detecting portion (indicated as "key ON detecting portion") that detects a state in which an ignition switch (IGswt) of the internal combustion engine is turned on; an entrance pressure detecting portion (indicated as "Pin detecting portion") that detects pressure from the entrance side pressure sensor (Pin); a low pressure pump control portion (indicated as "EKP control portion") that performs drive control of the electromagnetic low pressure pump; a flow rate control valve control portion (indicated as "MeUn control portion") that performs control of the flow rate control valve provided in the high pressure pump; and a pressure control valve control portion (indicated as "PCV control portion") that performs control of the pressure control valve provided in the common rail. More specifically, these are realized through execution of a program by a micro computer (not shown in the figures). In addition to this, even though not shown in the figures, the ECU 40 is provided with a timer counter that counts time.

Among these elements, in the key ON detecting portion, at the start of the internal combustion engine, before cranking of the internal combustion engine starts, the state in which the ignition switch (IGswt) is turned on is detected, and a key ON state is output to the low pressure pump control portion, the flow rate control valve control portion and the pressure control valve control portion. Instead of detecting the state in which the ignition switch (IGswt) is turned on, an operating switch, which starts the pre-start control of the internal combustion engine, may be installed such that this operating switch can detect the ON state.

Further, in the entrance pressure detecting portion, a signal of the pressure (Pin) detected by the entrance side pressure sensor provided in the low pressure fuel passage is detected, and the detected pressure value (Pin) is output to the pressure control valve control portion.

Further, in the low pressure pump control portion, an ON-OFF signal is transmitted to an operating device of the electromagnetic low pressure pump, and low pressure fuel of a predetermined flow rate is pressure fed when the electromagnetic low pressure pump is turned on. However, rather than keeping a pumping quantity of the electromagnetic low pressure pump at a constant level, the pumping quantity of the electromagnetic low pressure pump can be controlled by changing a duty ratio of a pulse voltage that is supplied to the electromagnetic low pressure pump from the operating device based on a flow rate designated by the low pressure pump control portion. With the low pressure pump control portion of the ECU 40 according to the present embodiment, the electromagnetic low pressure pump starts being driven when the key ON state signal is transmitted from the key ON detecting portion, before the start of the internal combustion engine.

Further, with the flow rate control valve control portion and the pressure control valve control portion, an operating signal corresponding to a designated flow rate or a target rail pressure is output to an operating device of the flow rate control valve control portion and an operating device of the pressure control valve control portion respectively, such that the flow rate control valve and the pressure control valve are controlled by each operating device based on the transmitted operating signal, and a fuel flow rate fed to the common rail and a fuel flow rate discharged from the common rail are controlled.

Note that, for the flow rate control valve and the pressure control valve of the present embodiment, a normally-open type proportional electromagnetic valve is used that becomes fully open in a state in which no electric current is supplied, in which, when the duty ratio of the supplied pulse voltage becomes larger, the flow rate becomes smaller. However, a normally-closed type proportional electromagnetic valve may be used.

With the ECU 40 of the present embodiment, in a case that the electromagnetic low pressure pump starts being driven by the low pressure pump control portion before the start of the internal combustion engine, during the period until the internal combustion engine is started up, the flow rate control valve control portion is controlled such that flow rate control valve is always kept fully opened. On the other hand, in a case where the electromagnetic low pressure pump starts being driven by the low pressure pump control portion before the start of the internal combustion engine, as described below, during the period until the internal combustion engine is started up, the pressure control valve control portion is controlled such that the pressure control valve is basically kept fully closed and it is opened at least once for a short period of time after the entrance pressure goes over a predetermined standard value. As a result, the pressure within the common rail is increased before the start of the internal combustion engine, while the occurrence of the noise caused by the circulation of fuel within the fuel supply apparatus is suppressed and air bubbles mixed into the fuel supply paths of the fuel supply apparatus are discharged.

Note that, as will be described below, the pressure control valve can be controlled not only such that it is opened at least once for a short period of time after the entrance pressure goes over a predetermined standard value, but also such that it is opened when a predetermined period of time elapses after the electromagnetic low pressure pump starts being driven.

Figure 4:
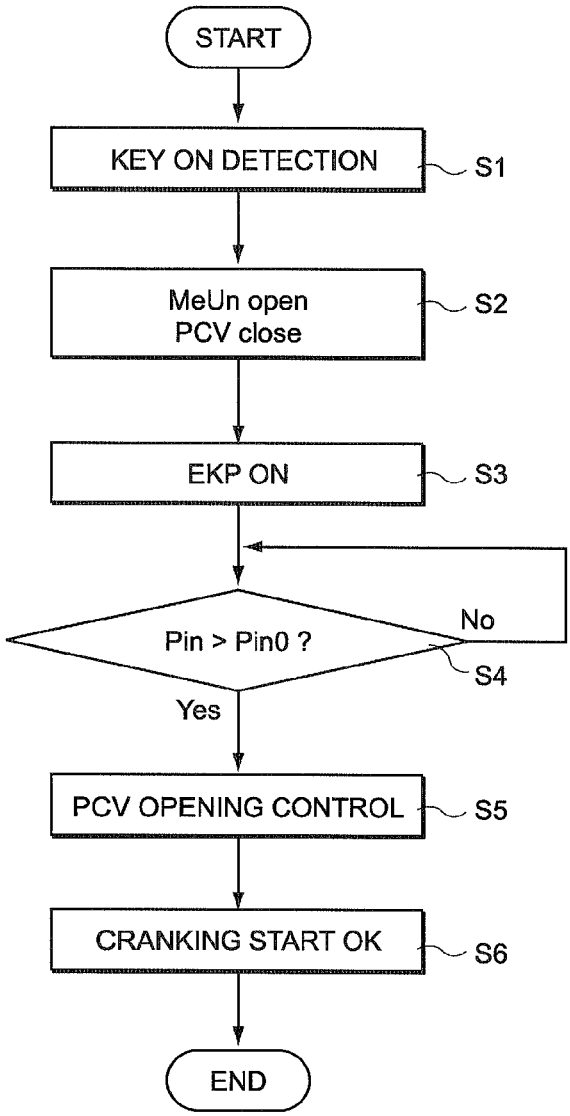
FIG. 4 shows the flow of a concrete example 1 of a control prior to a start of the internal combustion engine according to the first embodiment.

3. Pre-Start Control of Internal Combustion Engine (1) Concrete Example 1 of Pre-Start Control Next, an example of a pre-start control of the internal combustion engine that is performed by the ECU 40 shown in FIG. 3 will be explained in concrete terms based on the flow shown in FIG. 4 and a time chart in FIG. 5.

Figure 5:
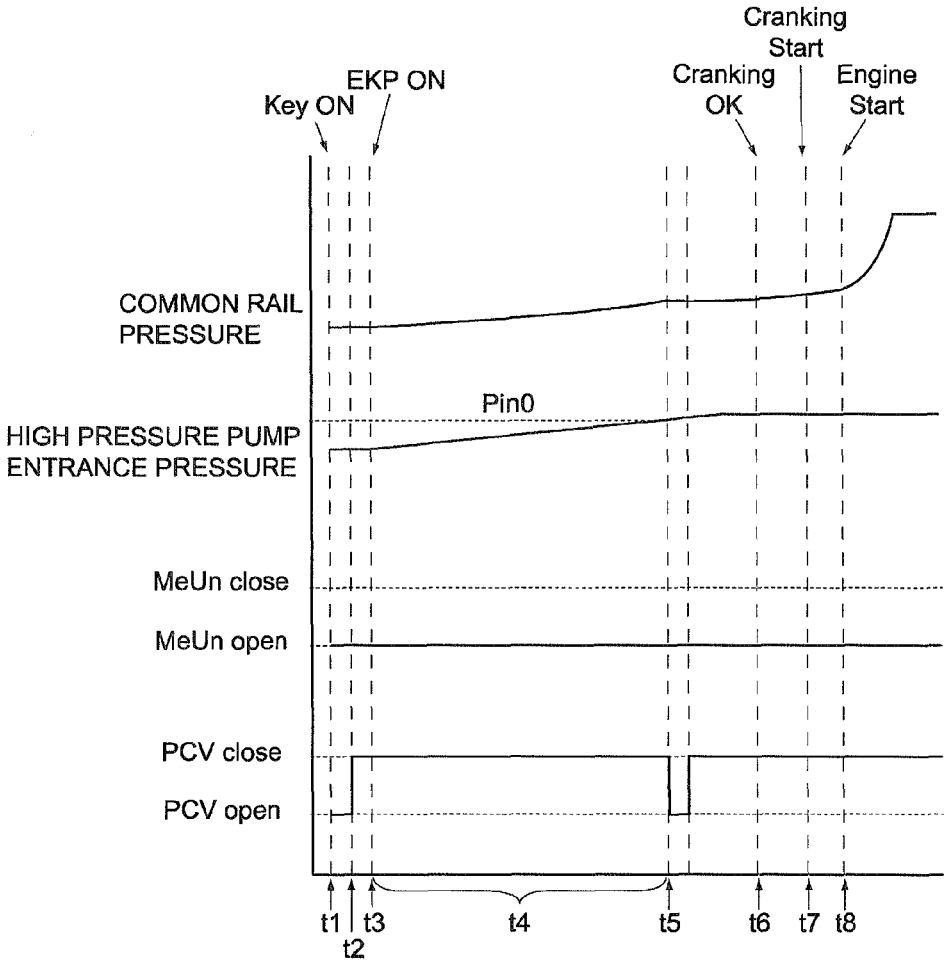
FIG. 5 is a time chart showing the concrete example 1 of the control prior to the start of the internal combustion engine according to the first embodiment.

First, at step S1, it is detected that the ignition switch is turned on in a state in which the internal combustion engine is stopped (t1 in FIG. 5). As described above, at this step S1, instead of detecting that the ignition switch is turned on, it may be detected that the operating switch of the pre-start control of the internal combustion engine is turned on.

After it is detected that the ignition switch is turned on at step S1, at step S2, the flow rate control valve MeUn is fully opened, and at the same time the pressure control valve PCV is fully closed (t2 in FIG. 5). In the present embodiment, since normally-open type valves are used for a flow rate control valve MeUn and a pressure control valve PCV, and in a state of no energization, both the flow rate control valve MeUn and the pressure control valve PCV are fully opened, at step S2, a voltage is supplied to the pressure control valve PCV such that the pressure control valve PCV is fully closed.

Next, at step S3, the electromagnetic low pressure pump EKP starts being driven (t3 in FIG. 5). By starting driving the electromagnetic low pressure pump EKP and supplying fuel inside the fuel supply apparatus before the start of the internal combustion engine, the pressure within the common rail can be increased in advance such that a starting time from a start of the cranking to the start of the internal combustion engine can be shortened. At this time, at step S2, the pressure control valve PCV is fully closed, while the flow rate control valve MeUn is fully opened, such that a significantly large flow rate of fuel does not circulate through each valve, fuel pipe etc. within the fuel supply apparatus. Therefore, regardless of the fact that the fuel is being supplied within the fuel supply apparatus before the start of the internal combustion engine, noise that irritates the ear cannot be heard.

Next, at step S4, it is determined whether or not the pressure value Pin of the entrance pressure sensor of the high pressure pump exceeds a predetermined standard value Pin0 (a period t4 in FIG. 5). When the entrance pressure Pin of the high pressure pump is below the standard value Pin0, a NO determination is made, and this step S4 is repeated until the entrance pressure Pin exceeds the standard value Pin0. Then, when the entrance pressure Pin exceeds the standard value Pin0, a YES determination is made, the process advances to step S5, and the pressure control valve PCV that is in a state of being fully closed is controlled to open at least once for a short period of time (t5 in FIG. 5). This control of the pressure control valve PCV is a control performed to discharge the air bubbles or air held in the fuel supply apparatus, and in a case in which air bubbles or air are mixed into the fuel supply paths, for example, when the internal combustion engine is stopped for a long period of time, or the internal combustion engine is restarted after being refueled after so-called running out of gas, a fuel injection quantity control can be stabilized promptly. Further, in the example of the present embodiment, since the opening control of the pressure control valve PCV is performed in a state in which the entrance pressure Pin of the high pressure pump is equal to or larger than the predetermined standard value Pin0, air bubbles or air are efficiently discharged when the pressure control valve PCV is opened.

In the example of the time chart shown in FIG. 5, the control corresponding to step S5 in which the pressure control valve PCV is opened for a short period of time is performed only once. This short-time valve opening time can be set, for example, from 0.5 to 1.5 seconds, but it is not limited to this time range, and it can be set as appropriate in accordance with a quantity of air bubbles or air, a noise occurrence condition, and fluctuation of the pressure within the common rail. Namely, even though the air bubbles or air are discharged when a pre-start drive of the electromagnetic low pressure pump EKP is performed in a state in which the pressure control valve PCV is opened, since it becomes difficult to increase the pressure with the common rail, the pressure control valve PCV is basically being closed toward a fully closed position, while it is opened at least once on the way. Then, taking into consideration making it difficult to hear a noise occurring when fuel is circulated when the valve is opened, the pressure control valve is set such that the opening time of the pressure control valve PCV does not become too long.

Figure 6:
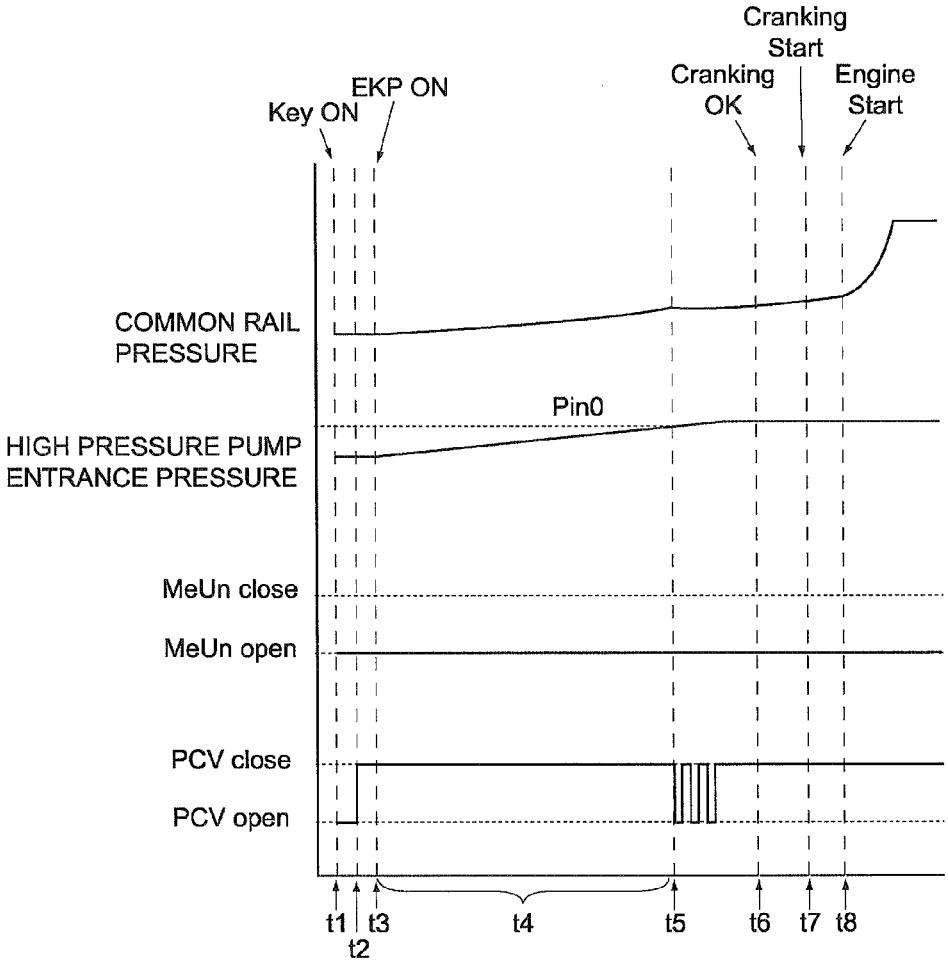
FIG. 6 is a time chart showing another example of a control prior to the start of the internal combustion engine according to the first embodiment.

The short-time valve opening control of the pressure control valve PCV performed for this kind of purpose can be performed a plurality of times, as shown in FIG. 6. However, when the pressure control valve PCV is open, fuel is circulated within the fuel supply apparatus, and it becomes more likely that noise that irritates the ear will occur. It is therefore necessary for the valve opening time for one opening to be made short.

Further, regardless of how many times the pressure control valve PCV is opened, the extent to which the air bubbles or air that are held within the fuel supply paths can be discharged changes in accordance with a total time of the valve opening time, and this can be a factor that changes a time period from the start of the cranking to the start of the internal combustion engine. Therefore, it is preferable that the valve opening control is performed a plurality of times, while the valve opening time of the pressure control valve PCV for one opening is made as short as possible, for example, within 0.3 to 1.0 second, and the number of valve opening times, namely the total valve opening time, is determined in accordance with the quantity of the air bubbles or air.

After step S5 is finished, the process advances to step S6, and a signal that indicates the cranking may be started is transmitted to informing means such as a notification lamp (t6 in FIG. 5). Namely, at the time when step S5 is finished, since the fuel supply apparatus is reliably filled with fuel, discharging the air bubbles or air is completed and the fuel pressure is also in a state of being increased, the driver is informed that the cranking may be started. As a result, the cranking is started by the driver (t7 in FIG. 5), and the internal combustion engine is started promptly (t8. in FIG. 5).

As described above, in a case such as when the fuel tank is refilled at a time when the fuel runs out, a lot of air comes to be mixed into the fuel supply paths of the fuel supply apparatus, so even though the electromagnetic low pressure pump starts being driven, it takes some time for the fuel to be filled. Therefore, even though the above-described pre-start control of the internal combustion engine is performed such that the time required until the start of the internal combustion engine is shortened, it takes a relatively long time for the internal combustion engine to reach a state in which it can be started. Therefore, in the example of the present embodiment, at the time when the pressure within the fuel supply paths exceeds Pin0, and also the control to open the pressure control valve PCV is finished, a signal that gives permission to start cranking is issued to the driver. Hence, the cranking time is shortened in comparison with a case in which the cranking is started immediately after the ignition switch is turned on, and moreover, a load on the battery is reduced, since the internal combustion engine is started promptly after the start of the cranking.

(2) Concrete Example 2 of Pre-Start Control

With the above-described concrete example 1, the start of control of the pressure control valve PCV is triggered by the timing at which the entrance pressure Pin of the high pressure pump exceeds the standard value Pin0. However, as in a concrete example 2 described below, the start of control of the pressure control valve PCV may be set to be triggered by an elapse of a standard period of time, a standard value being set for the elapsed period of time after drive of the electromagnetic low pressure pump EKP has started.

Figure 7:
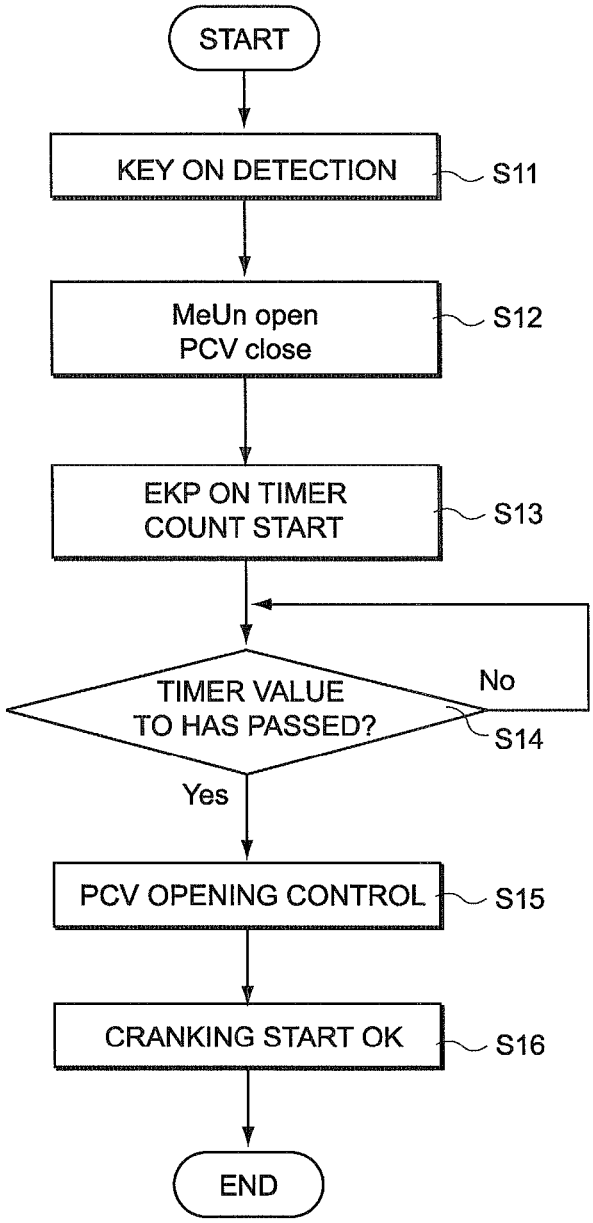
FIG. 7 shows the flow of a concrete example 2 of a control prior to the start of the internal combustion engine according to the first embodiment.
Figure 8:
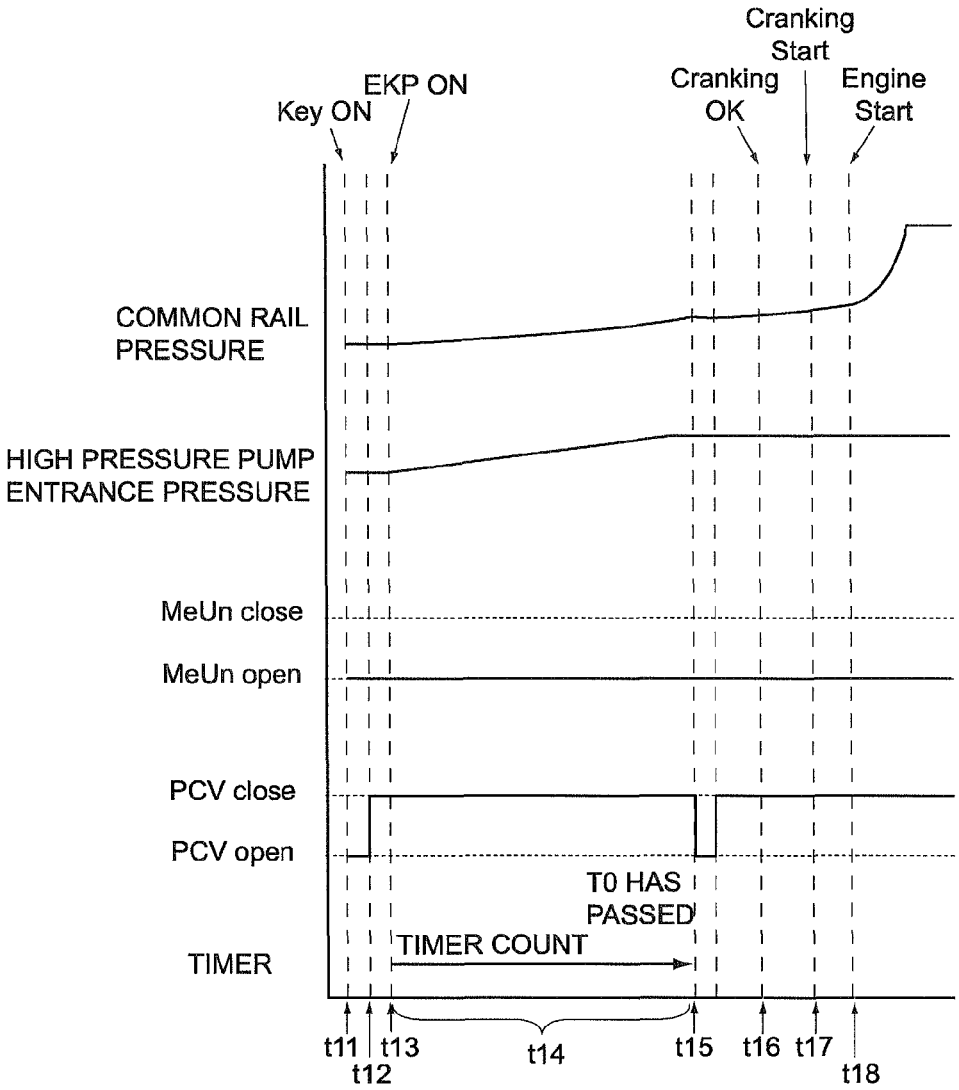
FIG. 8 is a time chart showing the concrete example 2 of the control prior to the start of the internal combustion engine according to the first embodiment.

FIG. 7 and FIG. 8 show the flow and a time chart illustrating the concrete example 2 of the present embodiment.

First, in the same way as at step S1 and step S2 of the above-described concrete example 1, after it is detected that the ignition switch is turned on at step S11 (t11 in FIG. 8), at step S12, the flow rate control valve MeUn is fully opened, and at the same time the pressure control valve PCV is fully closed (t12 in FIG. 8).

Next, at step S13, as at step S3 of the concrete example 1, the electromagnetic low pressure pump EKP starts being driven, and in this concrete example 2, a time count is also started (t13 in FIG. 8). After that, at step S14 it is determined whether or not the timer that starts counting at step S13 has passed a predetermined timer value T0 (t14 in FIG. 8). The determination at step S14 is repeated until the timer passes the timer value T0, and when the timer passes the timer value T0, the process advances to step S15, and the pressure control valve PCV that is fully closed is controlled to open at least once for a short period of time (t15 in FIG. 8). This timer value T0 is set to a minimum period of time for filling the fuel supply apparatus with fuel. As an example, it is set to around 25 to 35 seconds.

After the opening and closing control of the pressure control valve PCV is finished at step S15, the process advances to step S16, and, as at step S6 of the concrete example 1, a signal that indicates the cranking may be started is transmitted to the informing means such as the notification lamp (t16 in FIG. 8). At this point in time, as the fuel supply apparatus is reliably filled with fuel, and also discharging of the air bubbles or air is completed, the cranking is started by the driver (t17 in FIG. 8), and the internal combustion engine is started promptly (t18. in FIG. 8). Therefore, the cranking time is shortened in comparison with a case in which the cranking is started immediately after the ignition switch is turned on, and moreover, the load on the battery is reduced, since the start is made promptly after the start of the cranking.

Second Embodiment

The fuel supply apparatus according to a second embodiment of the present invention has a basic structure similar to the structure of the fuel supply apparatus according to the first embodiment. However, where in the first embodiment, in the pre-start control of the internal combustion engine, the pressure control valve is fully closed and on the other hand the flow rate control valve is fully opened, while the pressure control valve is controlled to be opened at least once for a short period of time, in the present embodiment, in the pre-start control of the internal combustion engine, the flow rate control valve is fully closed and on the other hand the pressure control valve is fully opened, while the flow rate control valve is controlled to be opened at least once for a short period of time. In this respect, the present embodiment is different from the first embodiment. The structure of the control device, a control flow etc. that are different points from the first embodiment will be mainly described below.

1. Control Device (ECU) of Fuel Supply Apparatus

Figure 9:
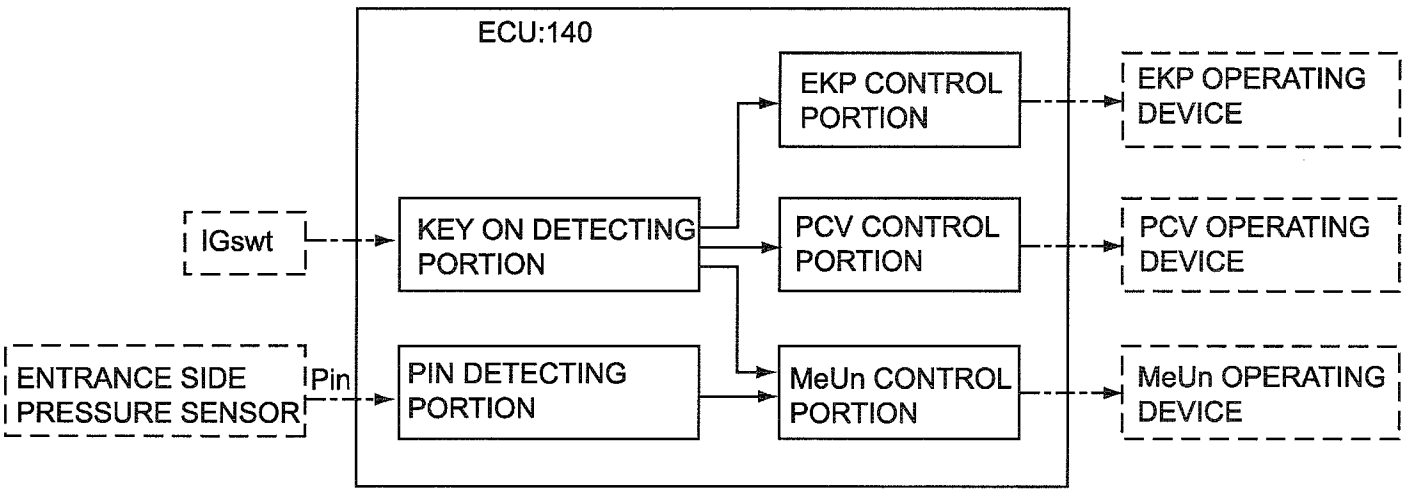
FIG. 9 is a diagram showing an example of a structure of a control device of a fuel supply apparatus according to a second embodiment.

FIG. 9 shows a structural example of the ECU 140 that controls the fuel supply apparatus 100 according to the present embodiment, in which parts of the ECU 140 that relate to pre-start control performed before the start of the internal combustion engine are displayed as functional blocks.

As in the first embodiment, an ECU 140 of the present embodiment is mainly provided with the key ON detecting portion (Key ON detecting portion), the entrance pressure detecting portion (Pin detecting portion), the low pressure pump control portion (EKP control portion), the flow rate control valve control portion (MeUn control portion), and the pressure control valve control portion (PCV control portion). Among these elements, the Key ON detecting portion and the low pressure pump control portion perform the same processing as with the ECU of the first embodiment.

On the other hand, with the ECU 140 of the present embodiment, in the entrance pressure detecting portion, a signal of the pressure (Pin) detected by the entrance side pressure sensor, which is provided in the low pressure fuel passage, is detected, and the detected pressure value (Pin) is output to the flow rate control valve control portion.

Further, in the pressure control valve control portion, in a case in which the electromagnetic low pressure pump starts being driven by the low pressure pump control portion before the start of the internal combustion engine, during the period until the internal combustion engine is started up, the pressure control valve control portion is controlled such that the pressure control valve is always kept fully opened. On the other hand, in the flow rate control valve control portion, in a case in which the electromagnetic low pressure pump starts being driven by the low pressure pump control portion before the start of the internal combustion engine, during the period until the internal combustion engine is started up, the flow rate control valve control portion is controlled such that the flow rate control valve is basically kept fully closed and it is opened at least once for a short period of time after the entrance pressure exceeds the predetermined standard value. In this way, the pressure within the common rail is increased before the start of the internal combustion engine, while the occurrence of noise caused by the circulation of fuel within the fuel supply apparatus is suppressed and air bubbles mixed into the fuel supply paths of the fuel supply apparatus are discharged.

2. Pre-Start Control of Internal Combustion Engine

Figure 10:
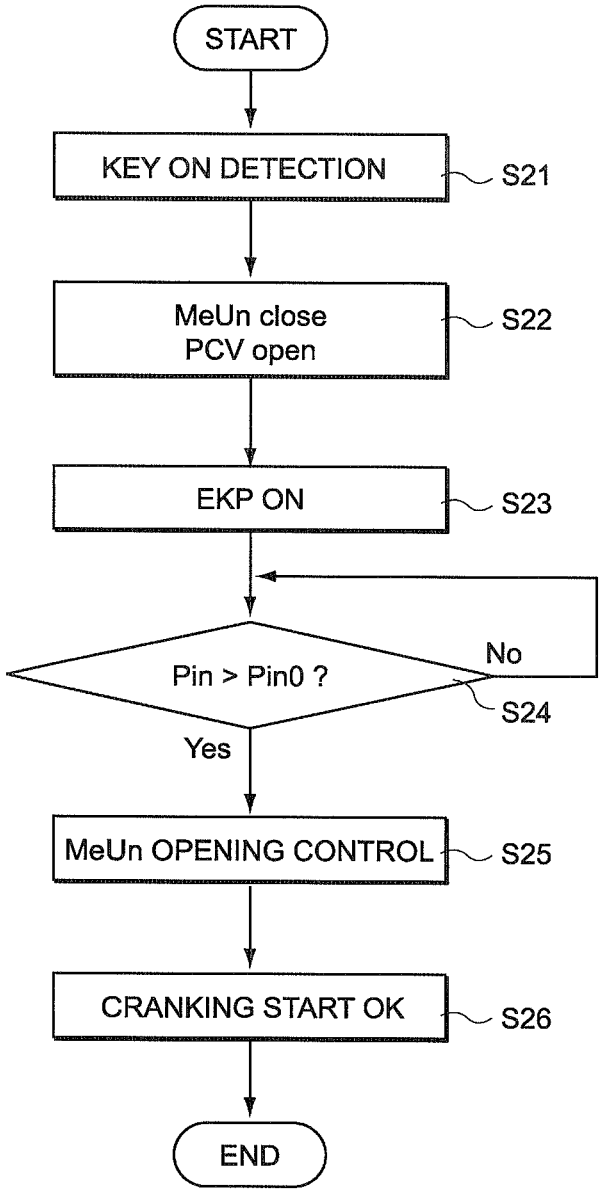
FIG. 10 shows the flow of a concrete example of a control prior to a start of the internal combustion engine according to the second embodiment.

Next, a concrete example of the pre-start control of the internal combustion engine that is performed by the ECU 140 shown in FIG. 9 will be described based on a flow shown in FIG. 10 and a time chart in FIG. 11

Figure 11:
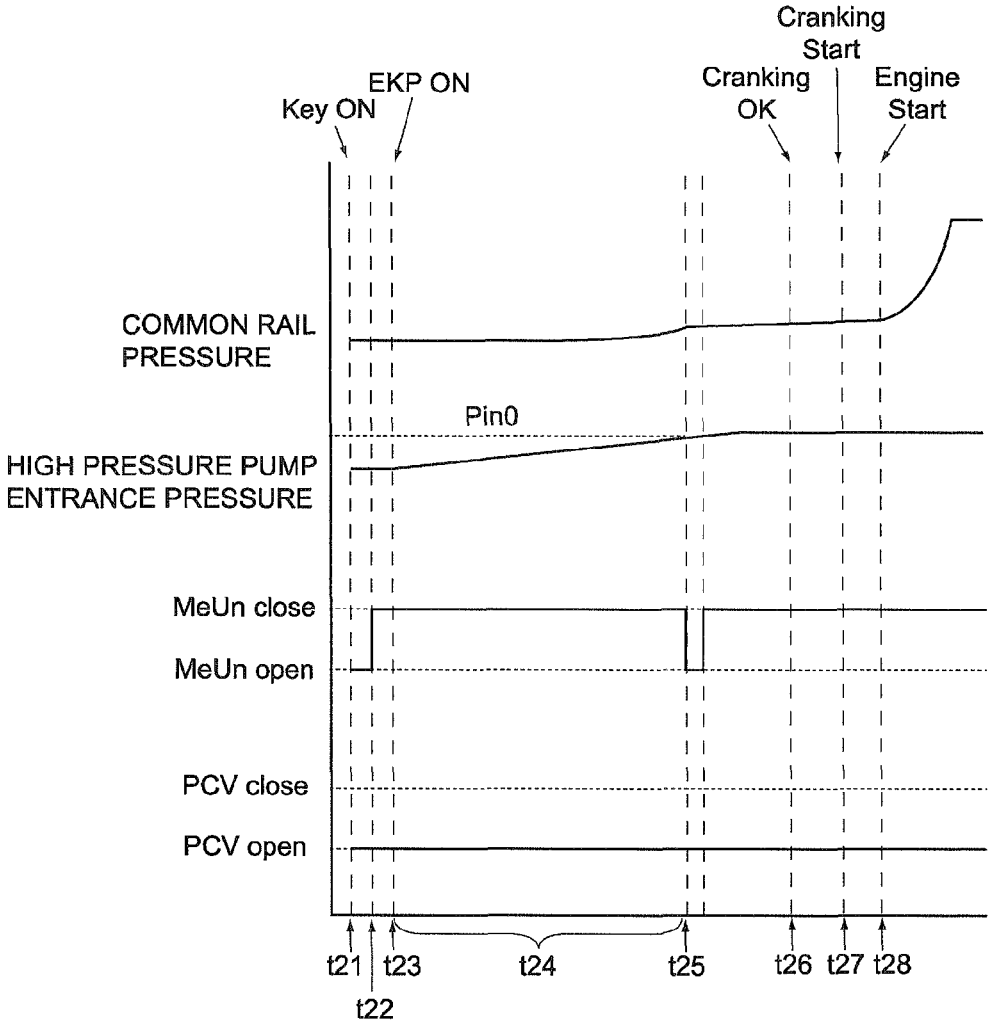
FIG. 11 is a time chart showing the concrete example of the control prior to the start of the internal combustion engine according to the second embodiment.
Figure 12:
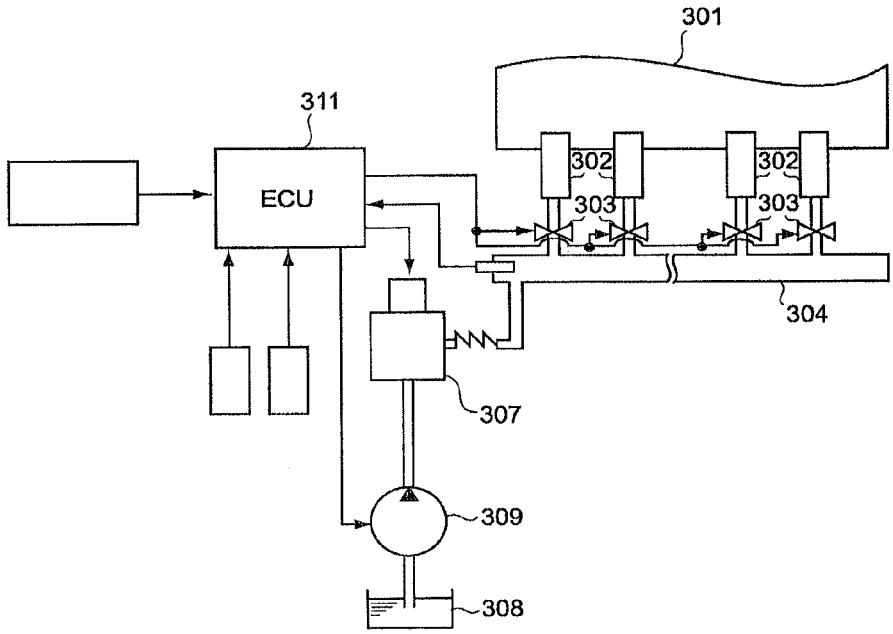
FIG. 12 is a diagram showing a structure of a known high pressure pump.
Figure 13:
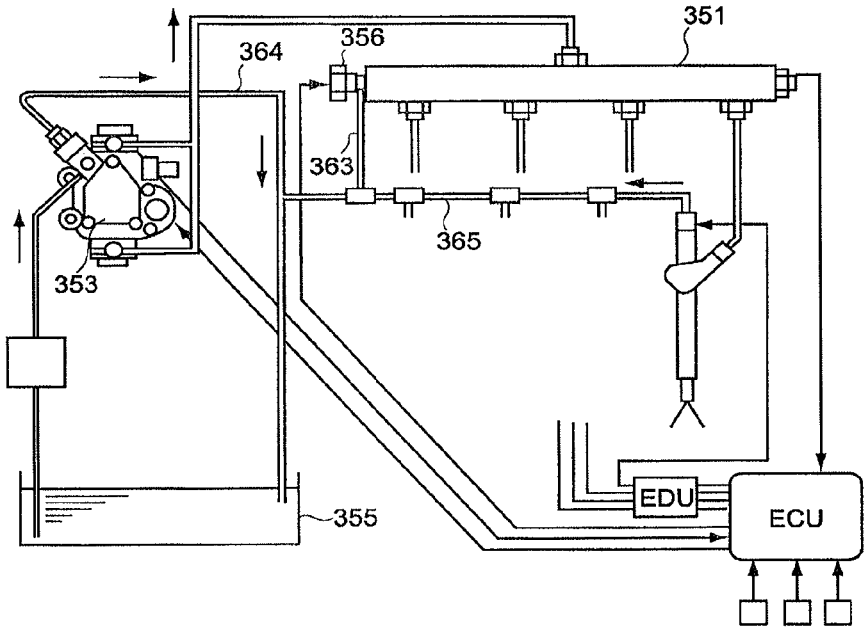
FIG. 13 is a diagram showing a structure of a known common rail type fuel supply apparatus.

First, at step S21, it is detected that the ignition switch is turned on in a state in which the internal combustion engine is stopped (t21 in FIG. 11). As described above, at step S21, instead of detecting that the ignition switch is turned on it may be detected that the operating switch of the pre-start control of the internal combustion engine is turned on.

After it is detected at step S21 that the ignition switch is turned on, at step S22, the flow rate control valve MeUn is fully closed, and at the same time the pressure control valve PCV is fully opened (t22 in FIG. 11). In the present embodiment, the normally-open type flow rate control valve MeUn and pressure control valve PCV are used, and, when in a state of no energization, both the flow rate control valve MeUn and the pressure control valve PCV are fully opened. Thus, at this step S22, a voltage is supplied to the flow rate control valve MeUn such that the flow rate control valve MeUn is fully closed.

Next, at step S23, the electromagnetic low pressure pump EKP starts being driven, and at the same time a time count starts (t23 in FIG. 11). At this time, at step S22, since the flow rate control valve MeUn is fully closed, while the pressure control valve PCV is fully opened, the fuel that is pressure fed into the fuel supply apparatus by the electromagnetic low pressure pump EKP does not return and circulate back to the fuel tank and thus noise that irritates the ear cannot be heard.

Next, at step S24, the entrance pressure Pin is repeatedly checked until the pressure value Pin of the entrance pressure sensor of the high pressure pump exceeds the predetermined standard value Pin0 (a period t24 in FIG. 11). Then, when the entrance pressure Pin exceeds the standard value Pin0, a YES determination is made, the process advances to step S25, and the flow rate control valve MeUn that is in a state of being fully closed is controlled to open at least once for a short period of time (t25 in FIG. 11). This control of the flow rate control valve MeUn is performed to discharge the air bubbles or air held in the fuel supply apparatus.

In the example of the time chart shown in FIG. 11, the short-time valve opening control of the flow rate control valve MeUn corresponding to step S25 is performed only once, but as described in relation to the first embodiment, the short-time valve opening control of the flow rate control valve MeUn can be performed a plurality of times.

After this step S25 is finished, the process advances to step S26, and a signal that indicates that cranking can be started is transmitted to informing means such as a notification lamp (t26 in FIG. 11). Namely, at the time at which step S25 is finished, since the fuel supply apparatus is reliably filled with fuel, discharging the air bubbles or air is completed, and the fuel pressure is in a state of being increased, the driver is informed that the cranking can be started. As a result, the cranking is started by the driver (t27 in FIG. 11), and the internal combustion engine is started promptly (t28 in FIG. 11). Therefore, cranking time is shortened in comparison with a case in which the cranking is started immediately after the ignition switch is turned on, and moreover, the load on the battery is reduced, since the start is made promptly after the start of the cranking.

Note that, as described in relation to the first embodiment, various modifications can be made with respect to the pre-start control of the fuel supply apparatus of the present embodiment.

INDUSTRIAL APPLICABILITY

As described above, according to the present invention, the pressure within the common rail can be increased before the start of the internal combustion engine, and at the same time, even when air is remaining in the fuel supply paths, the air can be discharged while suppressing the occurrence of noise. Therefore, the period of time from the start of cranking to the start of the internal combustion engine is shortened.

Further, when a vehicle etc. that is provided with the internal combustion engine is shipped from a factory, operating efficiency is improved by performing the control of the present invention, since the period of time required until the internal combustion engine is started is shortened.

The invention claimed is:

1. A fuel supply apparatus of an internal combustion engine that supplies fuel inside a fuel tank to a high pressure pump by a low pressure pump, highly pressurizes the fuel by the high pressure pump, pressure feeds the fuel to a common rail that is connected to a fuel injection portion of the internal combustion engine, and supplies the fuel from the fuel injection portion to the internal combustion engine, comprising:

a flow rate control valve that adjusts a flow rate of the fuel supplied to the common rail; and a pressure control valve that reduces pressure within the common rail, the fuel supply apparatus comprising:

a pre-start drive control portion that performs a pre-start drive of the low pressure pump before a start of the internal combustion engine;

a flow rate control valve control portion that, while the pre-start drive is being performed, maintains the flow rate control valve in an open state; and a pressure control valve control portion that, while the pre-start drive is being performed, maintains the pressure control valve in a closed state and performs a control that opens the pressure control valve at least once for a short time period.

2. The fuel supply apparatus of the internal combustion engine according to claim 1, wherein a total time of the pressure control valve opening time during the period when the pre-start drive is being performed is set in accordance with an air quantity that intrudes into the fuel supply apparatus.

3. The fuel supply apparatus of the internal combustion engine according to claim 1, wherein the control that opens the pressure control valve at least once for the short time period is performed when the internal combustion engine is restarted after the fuel of the internal combustion engine runs out.

4. The fuel supply apparatus of the internal combustion engine according to claim 2, wherein the control that opens the pressure control valve at least once for the short time period is performed when the internal combustion engine is restarted after the fuel of the internal combustion engine runs out.

5. The fuel supply apparatus of the internal combustion engine according to claim 1, further comprising pressure detecting means for detecting a pressure of the fuel inside a fuel supply path between the low pressure pump and the flow rate control valve, wherein the pressure control valve control portion opens the pressure control valve at least once for the short time period in a state in which the pressure detected by the pressure detecting means exceeds a predetermined value.

6. The fuel supply apparatus of the internal combustion engine according to claim 2, further comprising pressure detecting means for detecting a pressure of the fuel inside a fuel supply path between the low pressure pump and the flow rate control valve, wherein the pressure control valve control portion opens the pressure control valve at least once for the short time period in a state in which the pressure detected by the pressure detecting means exceeds a predetermined value.

7. A fuel supply apparatus of an internal combustion engine that supplies fuel inside a fuel tank to a high pressure pump by a low pressure pump, highly pressurizes the fuel by the high pressure pump, pressure feeds the fuel to a common rail which is connected to a fuel injection portion of the internal combustion engine, and supplies the fuel from the fuel injection portion to the internal combustion engine, comprising:

a flow rate control valve that adjusts a flow rate of the fuel supplied to the common rail; and a pressure control valve that reduces pressure within the common rail, the fuel supply apparatus comprising:

a pre-start drive control portion that performs a pre-start drive of the low pressure pump before a start of the internal combustion engine;

a pressure control valve control portion that, while the pre-start drive is being performed maintains the pressure control valve in an open state; and a flow rate control valve control portion that, while the pre-start drive is being performed, maintains the flow rate control valve in a closed state and performs a control that opens the flow rate control valve at least once for a short time period.

8. A control device of a fuel supply apparatus that performs pre-start control of an internal combustion engine in the fuel supply apparatus that supplies fuel inside a fuel tank to a high pressure pump by a low pressure pump, highly pressurizes the fuel by the high pressure pump, pressure feeds the fuel to a common rail which is connected to a fuel injection portion of the internal combustion engine, and supplies the fuel from the fuel injection portion to the internal combustion engine, the control device of the fuel supply apparatus being comprising:

a pre-start drive control portion that performs a pre-start drive of the low pressure pump before a start of the internal combustion engine;

a flow rate control valve control portion that, while the pre-start drive is being performed, maintains the flow rate control valve in an open state and adjusts a flow rate of the fuel supplied to the common rail; and a pressure control valve control portion that, while the pre-start drive is being performed, maintains the pressure control valve that reduces pressure within the common rail in a closed state and also performs a control that opens the pressure control valve at least once for a short time period.

9. A control device of a fuel supply apparatus that performs pre-start control of an internal combustion engine in the fuel supply apparatus that supplies fuel inside a fuel tank to a high pressure pump by a low pressure pump, highly pressurizes the fuel by the high pressure pump, pressure feeds the fuel to a common rail which is connected to a fuel injection portion of the internal combustion engine, and supplies the fuel from the fuel injection portion to the internal combustion engine, the control device of the fuel supply apparatus comprising:

a pre-start drive control portion that performs a pre-start drive of the low pressure pump before a start of the internal combustion engine;

a pressure control valve control portion that, while the pre-start drive is being performed, maintains the pressure control valve in an open state that reduces pressure within the common rail; and a flow rate control valve control portion that, while the pre-start drive is being performed, maintains the flow rate control valve that adjusts a flow rate of the fuel supplied to the common rail in a closed state and also performs a control that opens the flow rate control valve at least once for a short time period.

* * * * *